US011612224B2

(12) United States Patent
Luo

(10) Patent No.: US 11,612,224 B2
(45) Date of Patent: Mar. 28, 2023

(54) SUNSHADE UMBRELLA CAPABLE OF ROTATING LEFT AND RIGHT

(71) Applicant: PHAETON MANUFACTURING LLC., Jiangsu (CN)

(72) Inventor: Xiong Luo, Jiangsu (CN)

(73) Assignee: PHAETON MANUFACTURING LLC., Jiangsu (CN)

( * ) Notice: Subject to any disclaimer, the term of this patent is extended or adjusted under 35 U.S.C. 154(b) by 231 days.

(21) Appl. No.: 17/287,533

(22) PCT Filed: Nov. 26, 2018

(86) PCT No.: PCT/CN2018/117390
§ 371 (c)(1),
(2) Date: Apr. 22, 2021

(87) PCT Pub. No.: WO2020/093471
PCT Pub. Date: May 14, 2020

(65) Prior Publication Data

US 2021/0386166 A1 Dec. 16, 2021

(30) Foreign Application Priority Data

Nov. 5, 2018 (CN) ..... 201811308619.3

(51) Int. Cl.
*A45B 23/00* (2006.01)
*A45B 17/00* (2006.01)

(52) U.S. Cl.
CPC ..... *A45B 17/00* (2013.01); *A45B 23/00* (2013.01); *A45B 2023/0012* (2013.01); *A45B 2023/0037* (2013.01)

(58) Field of Classification Search
CPC ..... A45B 2023/0081
See application file for complete search history.

(56) References Cited

U.S. PATENT DOCUMENTS 7,493,909 B2 * 2/2009 Ma ..... A45B 23/00 135/21
9,930,942 B2 * 4/2018 Ma ..... A45B 23/00
(Continued)

FOREIGN PATENT DOCUMENTS

CN 202552458 11/2012
CN 203538551 4/2014
(Continued)

OTHER PUBLICATIONS

"International Search Report (Form PCT/ISA/210) of PCT/CN2018/117390," dated Jul. 31, 2019, with English translation thereof, pp. 1-4.

*Primary Examiner* — Noah Chandler Hawk
(74) *Attorney, Agent, or Firm* — JCIP Global Inc.

(57) ABSTRACT

A sunshade umbrella capable of rotating left and right includes a base, a vertical column, a transverse rod, a drawing rod, an umbrella frame, a rotating mechanism for controlling the umbrella frame to rotate left and right, and an adjustment handle for driving the rotating mechanism to rotate. The umbrella frame has a lengthened rib, and a bottom end of the lengthened rib is connected to the rotating mechanism. The rotating mechanism includes an upper clutch tooth mechanism and a lower clutch tooth mechanism. The adjustment handle is disposed on the lower clutch tooth mechanism. The upper clutch tooth mechanism and the lower clutch tooth mechanism are respectively disposed at the top end and the bottom end of the transverse rod, and are connected with each other through a connecting rod.

10 Claims, 8 Drawing Sheets

(56) References Cited

U.S. PATENT DOCUMENTS

| | | | | |
|---|---|---|---|---|
| 2003/0010366 | A1* | 1/2003 | Glatz | A45B 23/00 135/21 |
| 2006/0169307 | A1 | 8/2006 | Lo | |
| 2014/0230867 | A1* | 8/2014 | Ma | A45B 17/00 135/20.1 |
| 2014/0311537 | A1 | 10/2014 | Ma | |

FOREIGN PATENT DOCUMENTS

| | | | | |
|---|---|---|---|---|
| CN | 204317727 | | 5/2015 | |
| DE | 102011009758 | B3 * | 7/2012 | A45B 17/00 |
| DE | 202013007893 | U1 * | 1/2014 | A45B 17/00 |
| EP | 2767185 | | 8/2014 | |

* cited by examiner

SUNSHADE UMBRELLA CAPABLE OF ROTATING LEFT AND RIGHT

CROSS-REFERENCE TO RELATED APPLICATION

This application is a 371 of international application of PCT application serial no. PCT/CN2018/117390, filed on Nov. 26, 2018, which claims the priority benefit of China application no. 201811308619.3, filed on Nov. 5, 2018. The entirety of each of the above mentioned patent applications is hereby incorporated by reference herein and made a part of this specification.

BACKGROUND

Technical Field

The present invention relates to the technical field of outdoor sunshade umbrellas, in particular to a sunshade umbrella that can rotate left and right.

Description of Related Art

As outdoor leisure appliances, sunshade umbrella have been widely used in leisure places such as squares, beaches, parks and courtyards, providing people with a comfortable cooling space. The position of the canopy of the currently used sunshade umbrellas is usually fixed and cannot be adjusted. However, people can be better protected from the sun and wind if the angle of the canopy can be adjusted and changed with the change of the wind direction and the inclination of the sun. For this purpose, many sunshade umbrellas with adjustable canopies have been proposed at present.

For example, Chinese application no. CN201220168486.6 disclosed a canopy adjustment mechanism for sunshade umbrellas, which comprises a shell sleeved on a curved arm of the sunshade umbrella and connected to a vertical column and a large curved arm of the sunshade umbrella, a top end of the vertical column is connected to a bottom end of the large curved arm via the shell. A groove is disposed on a convolution surface of the large curved arm in a length direction, a synchronous belt is disposed in the recess, a plug pin assembly engaged with the teeth on the synchronous belt is disposed at an inside middle position of the curved arm, one end of the plug pin assembly is connected to a spanner via a wire rope, so that the plug pin assembly is driven to separate from the synchronous belt by the spanner so as to adjust the curved arm. This adjustment way realizes the adjustment of the canopy by adjusting the curved arm, and is complicated in structure, troublesome in manufacturing, high in cost and inconvenient in operation.

For another example, Chinese application no. CN201320541314.3 disclosed a sunshade umbrella capable of adjusting the shading angle left and right. The sunshade umbrella comprises a base, a vertical column, a transverse rod, a drawing rod and an umbrella frame. The vertical column is inserted in the base. The transverse rod has a lower end placed on the vertical column and an upper end connected to the top of the canopy. The drawing rod has a rear end disposed on the top of the vertical column and a front end connected to the middle of the transverse rod. The top of the umbrella frame is rotatably connected to the upper end of the transverse rod. A sliding sleeve is sleeved on the vertical column. The lower end of the transverse rod is connected to the sliding sleeve by a lower joint of the transverse rod. A canopy adjustment mechanism is disposed between the lower joint of the transverse rod and the transverse rod. A lengthened rib is disposed on the umbrella frame, which has a lower end connected to the canopy adjustment mechanism. In such a sunshade umbrella, the rotation of the umbrella frame is driven by the rotation of a clutch tooth sleeve, so the sunshade angle can be adjusted steplessly from left to right. However, there is only one clutch tooth sleeve arranged at the lower end of the lengthened rib, so the structure is not stable enough. The handle is a sleeve. It is not convenient enough, and the adjustment angle cannot be displayed. Further improvement is needed in the structure.

SUMMARY

It is an object of the present invention to provide a sunshade umbrella capable of rotating left and right with reasonable design, convenient operation, and stable and reliable positioning, in view of the above technical status.

For achieving the first object, the sunshade umbrella capable of rotating left and right includes a base, a vertical column, a transverse rod, a drawing rod and an umbrella frame. The vertical column is mounted in the base. A slidable handle is sleeved on the vertical column. The transverse rod has a lower end connected to the slidable handle, and an upper end rotatably connected to a top portion of the umbrella frame. The drawing rod has a front end and a rear end, the rear end of the drawing rod is connected to a top portion of the vertical column, and the front end of the drawing rod is rotatably connected to a middle portion of the transverse rod. The top portion of the umbrella frame is rotatably connected to the upper end of the transverse rod. The umbrella further includes a rotating mechanism for controlling the umbrella frame to rotate left and right and an adjustment handle for driving the rotating mechanism to rotate. The umbrella frame has a lengthened rib with a bottom end and a top end, and the bottom end of the lengthened rib is connected to the rotating mechanism. The rotating mechanism includes an upper clutch tooth mechanism and a lower clutch tooth mechanism. The adjustment handle is disposed on the lower clutch tooth mechanism. The upper clutch tooth mechanism and the lower clutch tooth mechanism are respectively disposed at the upper end and the lower end of the transverse rod, and are connected with each other through a connecting rod.

Preferably, the transverse rod is a hollow tube, and the connecting rod is disposed inside the transverse rod. The lower clutch tooth mechanism includes a first lower clutch tooth and a second lower clutch tooth which are sleeved and engaged with each other. A bottom end of the first lower clutch tooth is rotatably connected to the slidable handle through a connector, the top end of the first lower clutch tooth is connected to the bottom end of the connecting rod, and the second lower clutch tooth is sleeved out of the first upper clutch tooth and is connected to the transverse rod and the lengthened rib. A spring is disposed inside the first lower clutch tooth to keep the first lower clutch tooth to move upward to engage with the second lower clutch tooth. The adjustment handle is rotatably disposed outside the second lower clutch tooth. The adjustment handle has a pushing protrusion, which abuts against the top end of the first lower clutch tooth and is disposed for pushing the first lower clutch tooth to move downward to disengage from the second lower clutch tooth.

Preferably, the upper clutch tooth mechanism includes a first upper clutch tooth and a second upper clutch tooth which are sleeved and engaged with each other. The first upper clutch tooth and the second upper clutch tooth are both disposed inside the transverse rod, and the first upper clutch tooth is fixed with the upper end of the transverse rod. A rotating member is disposed at the top portion of the umbrella frame, and the rotating member is rotatably connected to the top end of the first upper clutch tooth. The bottom end of the second upper clutch tooth is connected to the top end of the connecting rod. When the first lower clutch tooth moves downward driven by the adjustment handle to disengage from the second lower clutch tooth, the connecting rod also moves downward and drives the second upper clutch tooth to move downward to disengage from the first upper clutch tooth, so as to allow the umbrella frame to rotate left and right.

Preferably, the first lower clutch tooth and the second lower clutch tooth are both circular sleeve structures, and the lower end of the transverse rod is inserted and fixed with the top end of the second lower clutch tooth. A plurality of ring teeth are disposed at the bottom end of the inner wall of the second lower clutch tooth, and a tooth surface matching the ring teeth is disposed at the top end of the first lower clutch tooth, and a plurality of rotating scales capable of displaying a rotation angle are circumferentially disposed on the outer peripheral surface of the top end of the first lower clutch tooth. A diameter-expanded stepped hole is disposed at the bottom end of the first lower clutch tooth, the top end of the connector is limited and embedded in the stepped hole, and the bottom end of the connector is rotatably connected to the slidable handle through a fixing member; and the spring is disposed in the stepped hole and supported between the top end of the connector and a stepped surface.

Preferably, a connecting pin is disposed on the stepped surface, and the bottom end of the connecting rod passing through the inner hole of the second lower clutch tooth is inserted into the first lower clutch tooth, and is fixedly connected to the connecting pin. An extension block is disposed on a side portion of the second lower clutch tooth, and a connecting chamber is formed in the extension block; the lengthened rib is movably disposed in the umbrella frame, and the bottom end of the lengthened rib is inserted into the connecting chamber of the extension block to connect with the second lower clutch tooth.

Preferably, the first upper clutch tooth and the second upper clutch tooth are both circular sleeve structures. A plurality of ring teeth are disposed at the bottom end of the inner wall of the first upper clutch tooth, and a tooth surface matching the ring teeth is disposed at the top end of the second upper clutch tooth. The bottom end of the second upper clutch tooth is fixedly connected to the top end of the connecting rod through a screw.

Preferably, a corresponding pin hole is radially disposed on the second upper clutch tooth, and a connecting pin is fixed in the corresponding pin hole on the second upper clutch tooth. A corresponding guide and limiting groove is disposed on a side portion of the transverse rod, the connecting pin is inserted in the corresponding pin hole and matched with the guide and limiting groove, so that the connecting rod is movable, in a limited manner, up and down in the transverse rod. A guide and fixing seat is disposed at the upper end of the transverse rod, and an upright guide column is disposed at a center of the guide and fixing seat. A central opening of the second upper clutch tooth is sleeved on the guide column of the guide and fixing seat, and a return spring is disposed between the guide and fixing seat and the second upper clutch tooth, such that the second upper clutch tooth always maintains an upward reset trend to be engaged and fixed with the first upper clutch tooth.

Preferably, the rotating member is a hinge, the top end of the first upper clutch tooth is hinged to a side portion of the hinge through a joint, and a bottom end of the hinge is connected to the top portion of the umbrella frame.

Preferably, the umbrella frame comprises a plurality of upper ribs, a plurality of lower ribs, an upper tray, a lower tray and a support post. The lower tray is slidingly disposed at a bottom end of the support post, and the upper tray is disposed in an upper part of the support post; one end of each of the upper ribs is rotatably connected to the upper tray, and one end of each of the lower ribs is rotatably connected to a middle portion of a respective one of the upper ribs, and the other end of each of the lower ribs is rotatably connected to the lower tray. A circular hole connected to the hinge is disposed at a top end of the support post, and the hinge is sleeved on the top end of the support post, and the hinge and the support post are connected and fixed by a screw.

Preferably, a top cover is disposed on the top of the vertical column. A drawing rod connecting sleeve is sleeved on the middle portion of the transverse rod, and one end of the drawing rod is rotatably connected to the top cover and the other end thereof is rotatably connected to the drawing rod connecting sleeve.

Compared with the prior art, the present invention has the following advantages. Under the design of the upper and lower clutch tooth mechanisms as a rotating mechanism, when in use, the lower clutch tooth mechanism is driven to be disengaged by turning the adjustment handle, and the upper clutch tooth mechanism is driven to be disengaged through the connecting rod. This realizes the left and right rotation to adjust the angle of the umbrella fabric, and it is easy to operate, and is stable and reliable. With the rotating scales, the angle of rotation can be controlled. The design of the present invention is not only reasonable in structure, but also convenient in operation, stable and reliable in positioning, can steplessly adjust the shading angle in left and right, can display the adjusted angle, and is thus highly practical.

DESCRIPTION OF THE EMBODIMENTS

Figure 1:
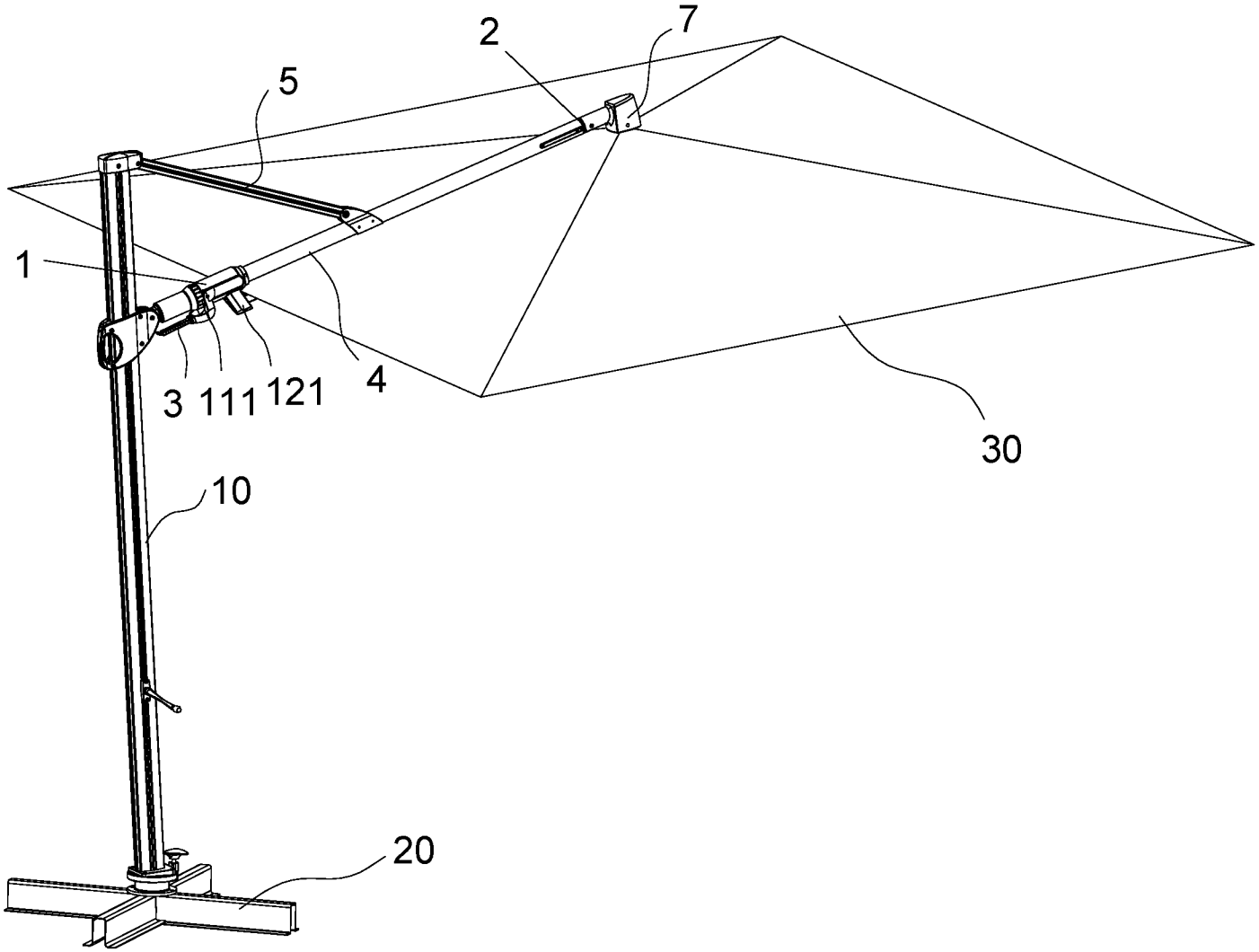
FIG. 1 is a perspective view of a sunshade umbrella capable of rotating left and right according to an embodiment of the present invention.
Figure 2:
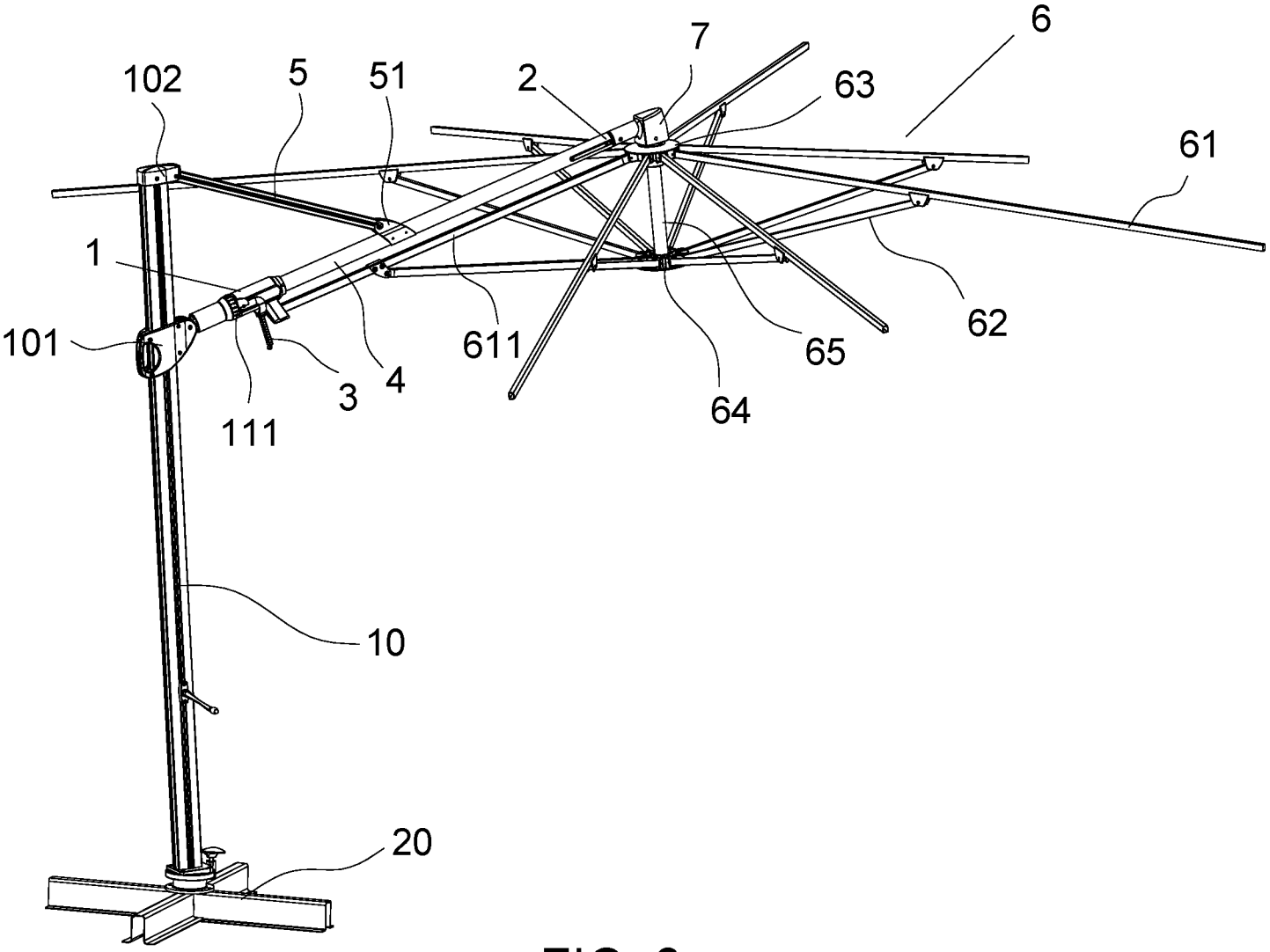
FIG. 2 is a perspective view of FIG. 1 with a fabric on an umbrella frame being removed.

The present invention will be further described below in detail with reference to the accompanying drawings by embodiments.

As shown in FIGS. 1-7, a sunshade umbrella capable of rotating left and right is provided. The sunshade umbrella includes a base 20, a vertical column 10, a transverse rod 4, a drawing rod 5, an umbrella frame 6, a fabric 30, a rotating mechanism and an adjustment handle 3. The vertical column 10 is inserted in the base 20. A lower end of the transverse rod 4 is placed on the vertical column 10 and is slidable up and down and is able to be locked, and a top portion of the umbrella frame 6 is rotatably connected to an upper end of the transverse rod 4. A rear end of the drawing rod 5 is connected to a top portion of the vertical column 10, and a front end of the drawing rod 5 is rotatably connected to a middle portion of the transverse rod 4. The top portion of the umbrella frame 6 is rotatably connected to the upper end of the transverse rod 4. The umbrella frame 6 comprises a plurality of upper ribs 61, a plurality of lower ribs 62, an upper tray 63, a lower tray 64 and a support post 65. The lower tray 64 is slidably disposed at a bottom end of the support post 65 in an up-down direction, and the upper tray 63 is disposed in an upper part of the support post 65. One end of each of the upper ribs 61 is rotatably connected to the upper tray 63, and one end of each of the lower ribs 62 is rotatably connected to a middle portion of a respective one of the upper ribs 61, and the other end of each of the lower ribs 62 is rotatably connected to the lower tray 64. The fabric 30 is sleeved on the upper ribs 61. A slidable handle 101 is sleeved on the vertical column 10, and the lower end of the transverse rod 4 is connected to the slidable handle 101, which is slidable along the vertical column 10. A top cover 102 is disposed on the top portion of the vertical column 10. A drawing rod connecting sleeve 51 is sleeved on the middle portion of the transverse rod 4, and the rear end of the drawing rod 5 is rotatably connected to the top cover 102, and the front end of the drawing rod 5 is rotatably connected to the drawing rod connecting sleeve 51. The umbrella frame 6 has a lengthened rib 611 with a bottom end and a top end, and the bottom end of the lengthened rib 611 is connected to the rotating mechanism. The rotating mechanism comprises an upper clutch tooth mechanism 2 and a lower clutch tooth mechanism 1. The adjustment handle 3 is disposed on the lower clutch tooth mechanism 1. The upper clutch tooth mechanism 2 and the lower clutch tooth mechanism 1 are respectively disposed at the upper end and the lower end of the transverse rod 4, and are connected with each other through a connecting rod 8 to be interlocked together.

The transverse rod 4 is a hollow tube. The connecting rod 8 is disposed inside the transverse rod 4. The lower clutch tooth mechanism 1 is composed of at least a first lower clutch tooth 11 and a second lower clutch tooth 12 which are sleeved and engaged with each other. A bottom end of the first lower clutch tooth 11 is rotatably connected to the slidable handle 101 through a connector 40, and a top end of the first lower clutch tooth 11 is connected to a bottom end of the connecting rod 8. The second lower clutch tooth 12 is sleeved out of an upper end of the first upper clutch tooth 11, and is connected to the transverse rod 4 and the lengthened rib 611. A spring 9 is disposed inside the first lower clutch tooth 11. The spring 9 keeps the first lower clutch tooth 11 to move upward to engage with the second lower clutch tooth 12. The adjustment handle 3 is rotatably disposed outside the second lower clutch tooth 12. The adjustment handle 3 has a pushing protrusion 31, which abuts against the top end of the first lower clutch tooth 11, and is disposed for pushing the first lower clutch tooth 11 to move downward to disengage from the second lower clutch tooth 12. The pushing protrusion 31 has a cam portion. The upper clutch tooth mechanism 2 is composed of at least a first upper clutch tooth 21 and a second upper clutch tooth 22, which are sleeved and engaged with each other. The first upper clutch tooth 21 and the second upper clutch tooth 22 are both disposed inside the transverse rod 4, and the first upper clutch tooth 21 is fixed with the upper end of the transverse rod 4. A rotating member 7 is disposed at the top portion of the umbrella frame 6, and the rotating member 7 is rotatably connected to a top end of the first upper clutch tooth 21. A bottom end of the second upper clutch tooth 22 is connected to a top end of the connecting rod 8. As such, when the first lower clutch tooth 11 moves downward driven by the pushing protrusion 31 of the adjustment handle 3 to disengage from the second lower clutch tooth 12, the connecting rod 8 also moves downward and drives the second upper clutch tooth 22 to move downward to disengage from the first upper clutch tooth 21, so as to allow the umbrella frame 6 to adjust by left and right rotation.

Figure 9:
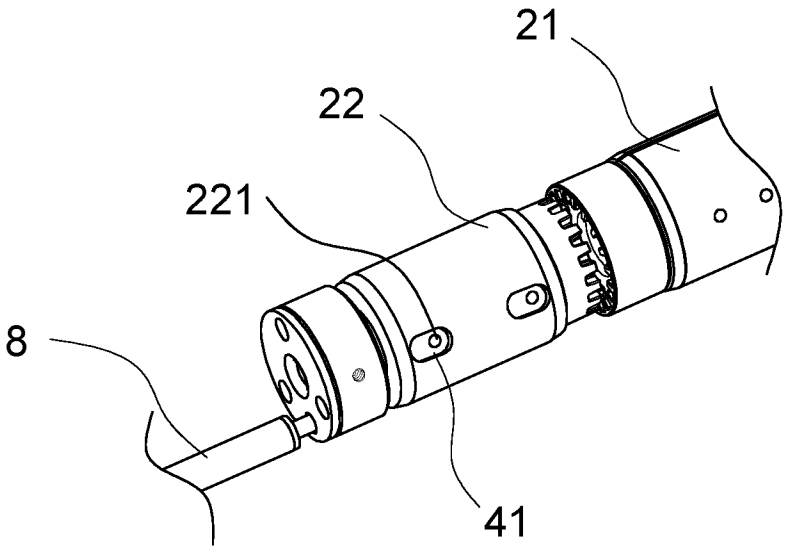
FIG. 9 is an enlarged view showing a portion of guide and limiting grooves corresponding to second upper clutch tooth of FIG. 6.
Figure 8:
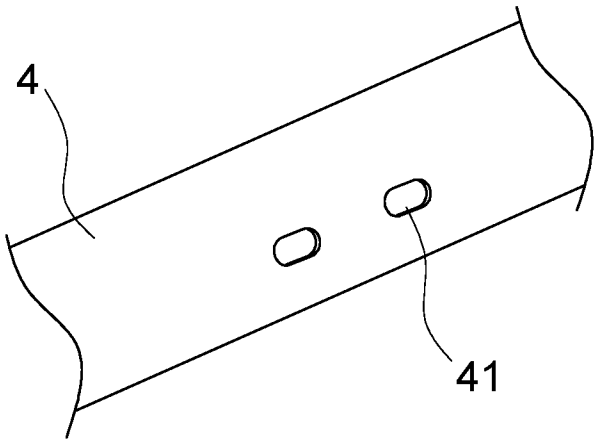
FIG. 8 is an enlarged view showing a part of the transverse rod of FIG. 6.

The specific structure will be described below. The first lower clutch tooth 11 and the second lower clutch tooth 12 are both circular sleeve structures. The lower end of the transverse rod 4 is inserted and fixed with the top end of the second lower clutch tooth 12. A plurality of ring teeth are disposed at the bottom end of the inner wall of the second lower clutch tooth 12, and a tooth surface matching the ring teeth is disposed at the top end of the first lower clutch tooth 11. A plurality of rotating scales 111 are circumferentially disposed on an outer peripheral surface of the top end of the first lower clutch tooth 11, and the rotating scales 111 is capable of displaying the rotation angle. A diameter-expanded stepped hole is disposed at the bottom end of the first lower clutch tooth 11, the top end of the connector 40 is limited and embedded in the stepped hole, and the bottom end of the connector 40 is rotatably connected to the slidable handle 101 through a fixing member, and is usually hinged to the slidable handle 101. The spring 9 is disposed in the stepped hole, and is supported between the top end of the connector 40 and a stepped surface of the stepped hole, so that the first lower clutch tooth 11 has a trend of always moving upward to engage with the second lower clutch tooth 12. A connecting pin 81 is disposed on the stepped surface, and the bottom end of the connecting rod 8 passing through an inner hole of the second lower clutch tooth 12 is inserted into the first lower clutch tooth 11, and is fixedly connected to the connecting pin 81. An extension block 121 is disposed on a side portion of the second lower clutch tooth 12, and a connecting chamber is formed in the extension block 121. The lengthened rib 611 is movably disposed in the umbrella frame 6, and the bottom end of the lengthened rib 611 is inserted into the connecting chamber of the extension block 121 to connect with the second lower clutch tooth 12. The first upper clutch tooth 21 and the second upper clutch tooth 22 are both circular sleeve structures. A plurality of ring teeth are disposed at the bottom end of the inner wall of the first upper clutch tooth 21, and a tooth surface matching the ring teeth is disposed at the top end of the second upper clutch tooth 22. The bottom end of the second upper clutch tooth 22 is fixedly connected to the top end of the connecting rod 8 through a screw; a corresponding pin hole 221 is radially disposed on the second upper clutch tooth 22, and a connecting pin is fixed in the corresponding pin hole 221 on the second upper clutch tooth 22. A corresponding guide and limiting groove 41 is disposed on a side of the transverse rod 4, the connecting pin is inserted in the corresponding pin hole 221, and is matched with the guide and limiting groove 41, so that the connecting rod 8 can move, in a limited manner, up and down in the transverse rod as shown in FIG. 8 and FIG. 9. The connecting rod 8 is connected to the transverse rod 4 by the connecting pin. A guide and fixing seat 23 is disposed at the upper end of the transverse rod 4, and an upright guide column is disposed at a center of the guide and fixing seat 23. A central opening of the second upper clutch tooth 22 is sleeved on the guide column of the guide and fixing seat 23, and a return spring is disposed between the guide and fixing seat 23 and the second upper clutch tooth 22. The return spring makes the second upper clutch tooth 22 always maintains an upward reset trend, so as to be engaged and fixed with the first upper clutch tooth 21. A double-head connecting screw passes through the guide and fixing seat 23 to connect to the connecting rod 8 and the second upper clutch tooth 22 by threads, respectively.

Additionally, the rotating member 7 on the top of the umbrella frame 6 is a hinge. A circular hole connected to the hinge 7 is disposed at the top end of the support post 65. The bottom end of the hinge 7 is sleeved on the top of the support post 65, and is connected to and fixed with the umbrella frame 6 by a screw. The top end of the first upper clutch tooth 21 is hinged to a side portion of the hinge through a joint 24.

Figure 3:
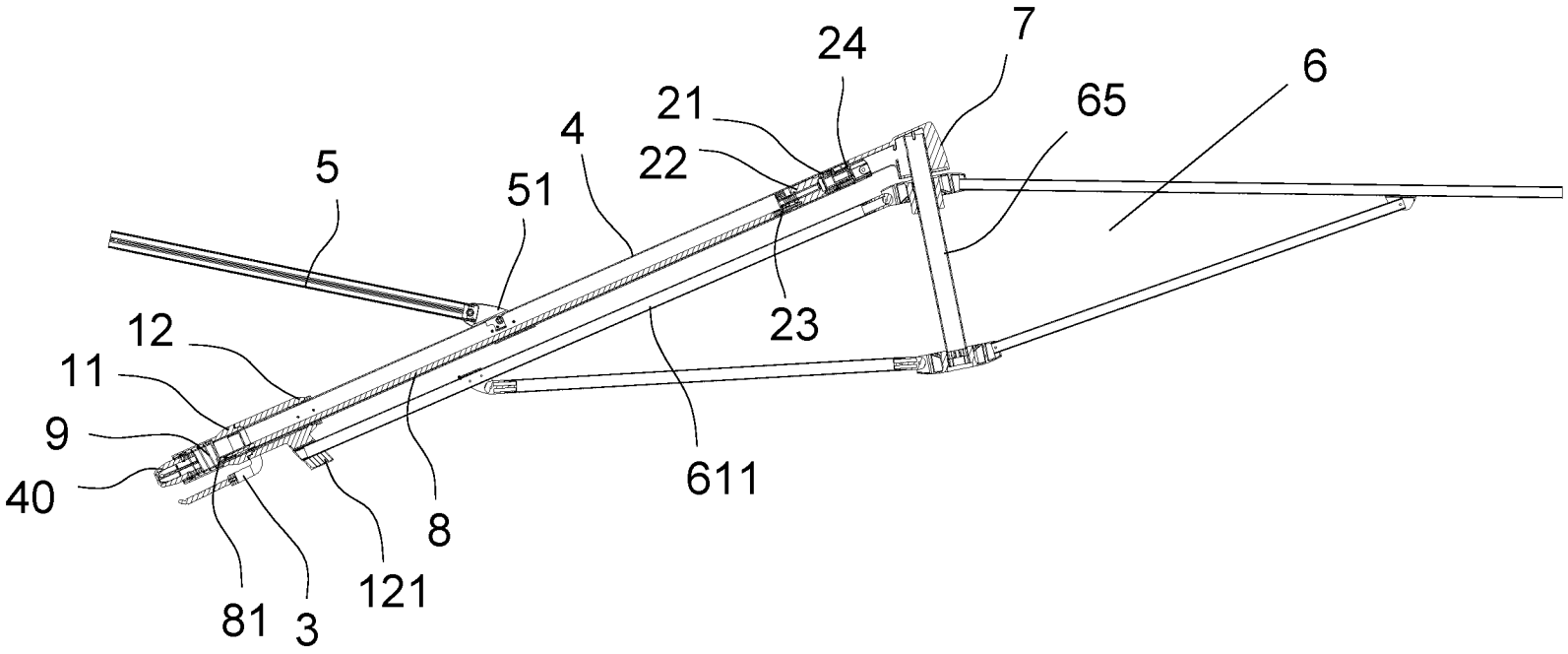
FIG. 3 is a sectional view of the umbrella frame, a transverse rod, a drawing rod and a rotating mechanism, when the adjustment handle being in a locked state.
Figure 4:
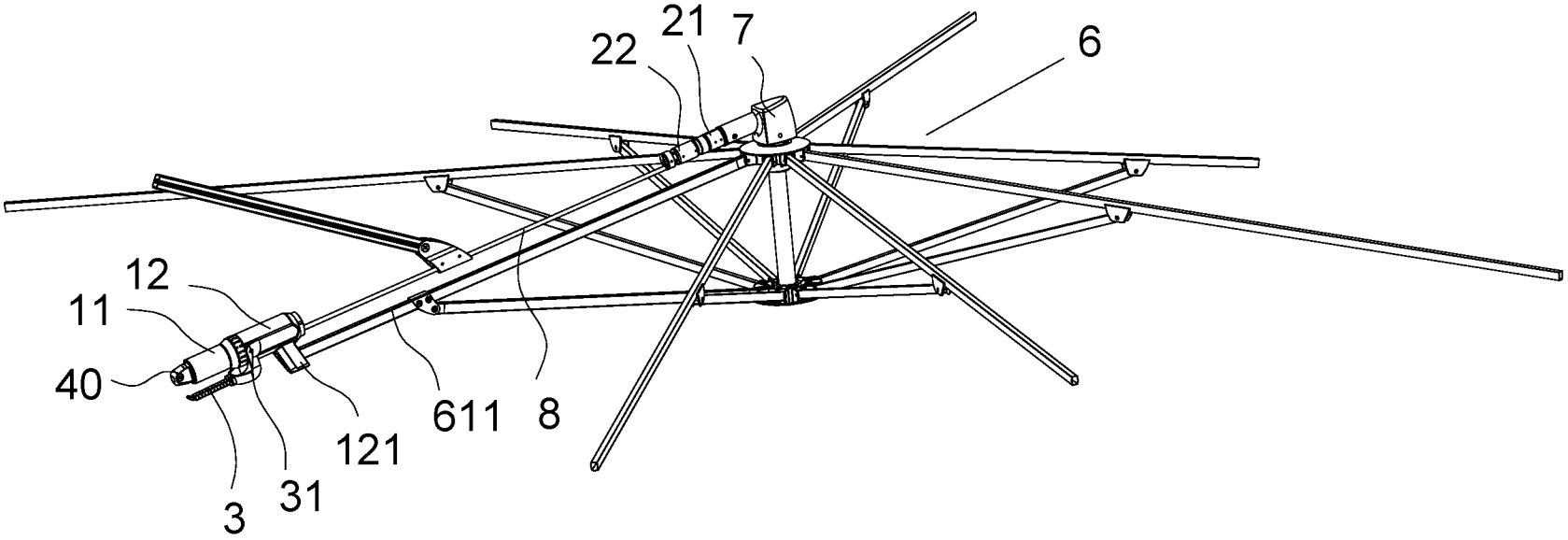
FIG. 4 is a perspective view of the umbrella frame, the transverse rod, the drawing rod and the rotating mechanism, when the handle being in the locked state.
Figure 5:
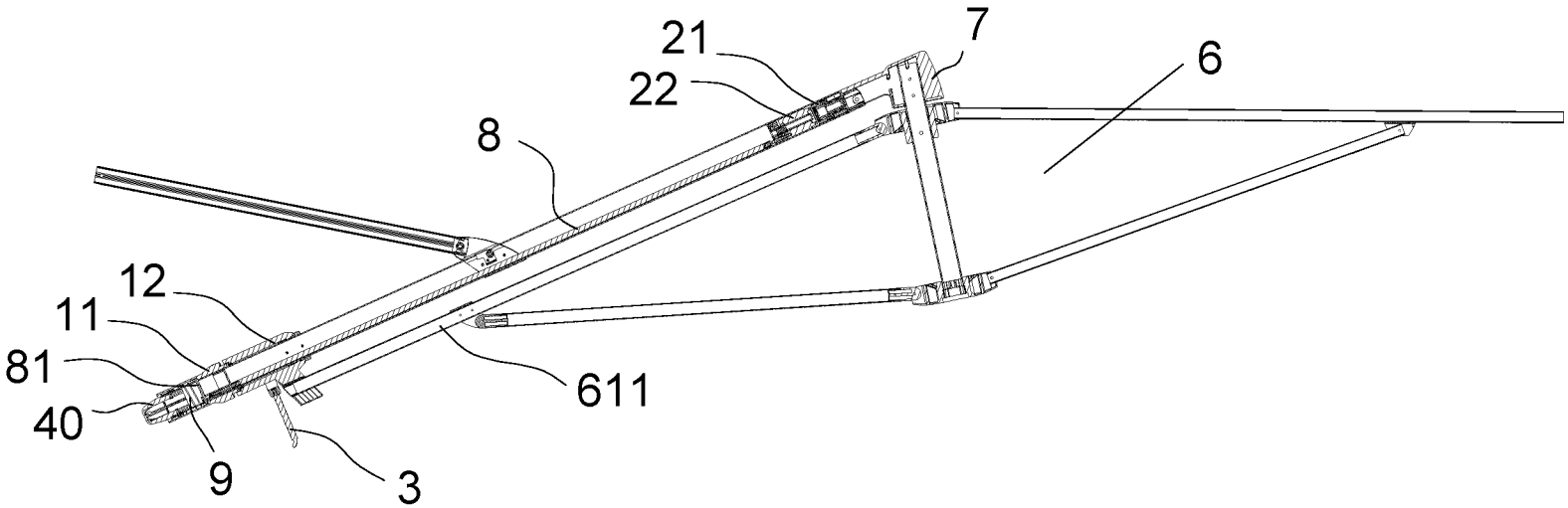
FIG. 5 is a sectional view of the umbrella frame, the transverse rod, the drawing rod and the rotating mechanism, when the handle being in an unlocked state.
Figure 6:
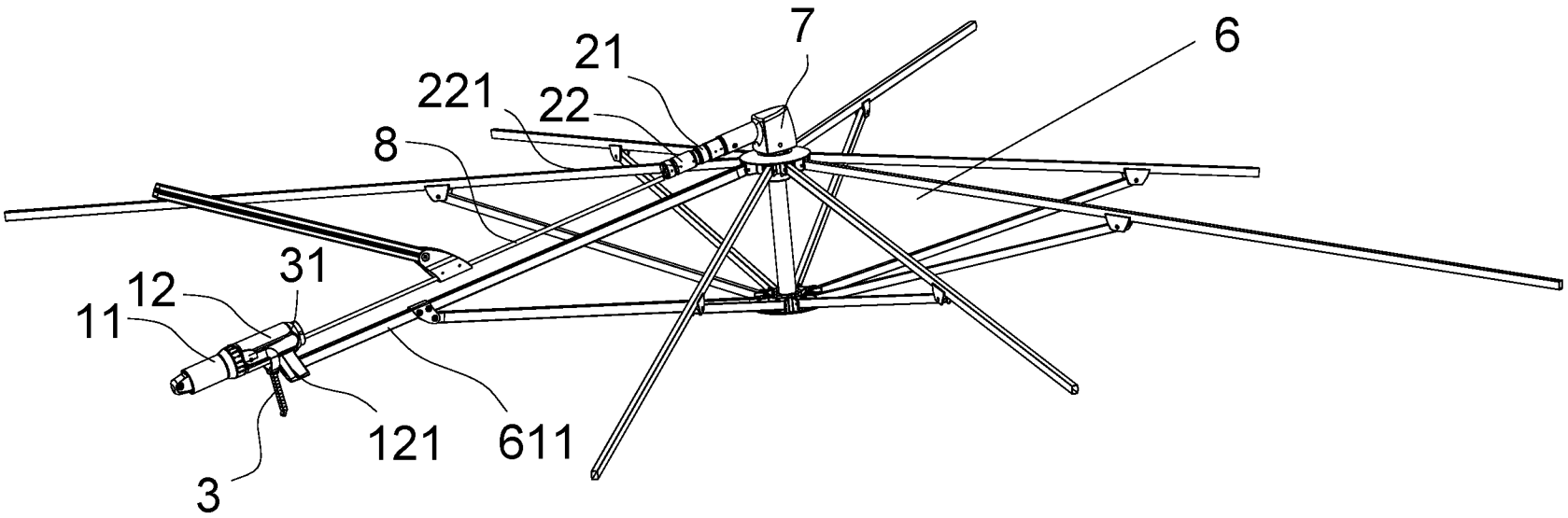
FIG. 6 is a perspective view of the umbrella frame, the transverse rod, the drawing rod and the rotating mechanism, when the handle being in the unlocked state.
Figure 7:
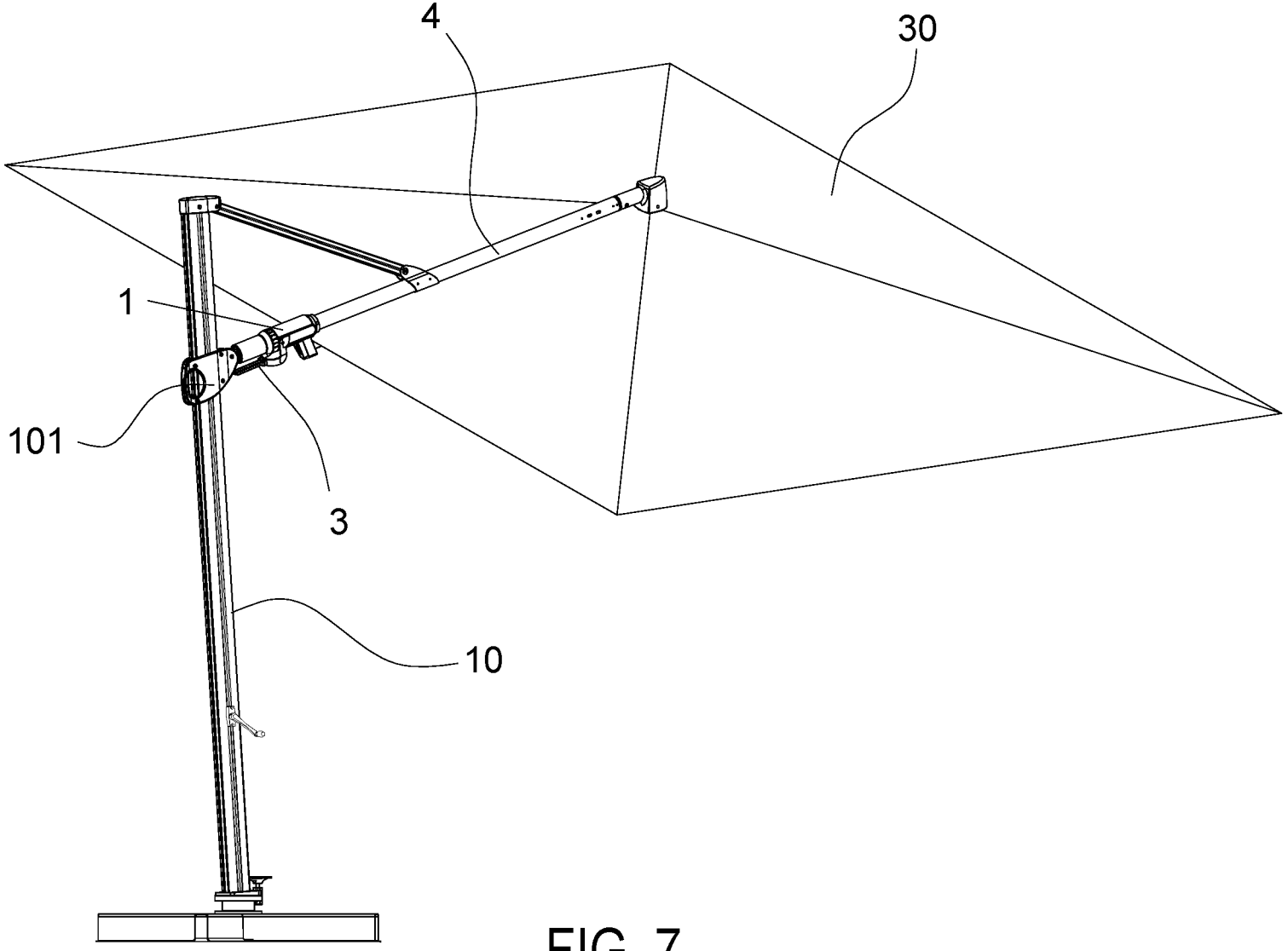
FIG. 7 is a perspective view of FIG. 1 after being rotated at a certain angle.

When in use, the rotating mechanism is controlled by both the upper clutch tooth mechanism 2 and the lower clutch tooth mechanism 1. The adjustment handle 3 is rotated upward, and the pushing protrusion 31 of the adjustment handle 3 pushes the first lower clutch tooth 11 backward, and the first lower clutch tooth 11 is disengaged from the second lower clutch tooth 12. The connecting pin 81 in the first lower clutch tooth 11 moves backward together with the first lower clutch tooth 11, the connecting rod 8 moves backward accordingly, the connecting rod 8 drives the second upper clutch tooth 22 to move backward against the elasticity of the return spring, and the second upper clutch tooth 22 is disengaged from the first upper clutch tooth 21. At this time, the teeth of the upper clutch tooth mechanism 2 and the teeth of the lower clutch tooth mechanism 1 are disengaged, as shown in FIGS. 5 and 6. The adjustment handle 3 may be rotated left and right. Since the adjustment handle 3 is connected to the second lower clutch tooth 12, the adjustment handle 3 drives the second lower clutch tooth 12 to rotate left and right. Since the lengthened rib 611 is connected to the second lower clutch tooth 12, the second lower clutch tooth 12 can drive the umbrella frame 6 to rotate, so as to realize the left and right rotation of the fabric (umbrella frame 6). After the umbrella frame 6 rotates to a suitable angle, stop rotating the adjustment handle 3. The rotation angle of the umbrella frame 6 is displayed on the rotating scales 111 on the outer periphery of the first lower clutch tooth 11. The adjustment handle 3 is released, the first lower clutch tooth 11 returns to its original position under the action of the spring 9, the first lower clutch tooth 11 is engaged with the second lower clutch tooth 12, the connecting pin 81 is driven to its original position, the connecting rod 8 is also driven to return to its original position by the connecting pin 81, and the connecting rod 8 drives the second upper clutch tooth 22 to return to its original position. The second upper clutch tooth 22 is again engaged with the first upper clutch tooth 21 under the action of the return spring. In this way, the teeth of the upper clutch tooth mechanism 2 and the teeth of the lower clutch tooth mechanism 1 are engaged together, and the umbrella frame 6 stops rotating and is locked, as shown in FIGS. 3 and 4.

The protection scope of the present invention is not limited to each embodiments described in this description. Any changes and replacements made on the basis of the scope of the present invention patent and of the description shall be included in the scope of the present invention patent.

What is claimed is:

1. A sunshade umbrella capable of rotating left and right, comprising:

a base;

a vertical column, mounted in the base;

a slidable handle, sleeved on the vertical column;

an umbrella frame;

a transverse rod, having a lower end connected to the slidable handle, and an upper end rotatably connected to a top portion of the umbrella frame; and a drawing rod, having a front end and a rear end, wherein the rear end of the drawing rod is connected to a top portion of the vertical column, and the front end of the drawing rod is rotatably connected to a middle portion of the transverse rod;

wherein the sunshade umbrella further comprising a rotating mechanism for controlling the umbrella frame to rotate left and right, and an adjustment handle for driving the rotating mechanism to rotate;

the umbrella frame has a lengthened rib with a bottom end and a top end, the bottom end of the lengthened rib is connected to the rotating mechanism;

the rotating mechanism comprises an upper clutch tooth mechanism and a lower clutch tooth mechanism; the adjustment handle is disposed on the lower clutch tooth mechanism; and the upper clutch tooth mechanism and the lower clutch tooth mechanism are respectively disposed at the upper end and the lower end of the transverse rod, and are connected with each other through a connecting rod.

2. The sunshade umbrella of claim 1, wherein the transverse rod is a hollow tube, the connecting rod is disposed inside the transverse rod;

the lower clutch tooth mechanism includes a first lower clutch tooth and a second lower clutch tooth which are sleeved and engaged with each other;

a bottom end of the first lower clutch tooth is rotatably connected to the slidable handle through a connector, a top end of the first lower clutch tooth is connected to a bottom end of the connecting rod, and the second lower clutch tooth is sleeved out of the top end of the first upper clutch tooth and is connected to the transverse rod and the lengthened rib;

a spring is disposed inside the first lower clutch tooth, and the spring keeps the first lower clutch tooth to move upward to engage with the second lower clutch tooth;

the adjustment handle is rotatably disposed outside the second lower clutch tooth;

the adjustment handle has a pushing protrusion, which abuts against the top end of the first lower clutch tooth and is disposed for pushing the first lower clutch tooth to move downward to disengage from the second lower clutch tooth.

3. The sunshade umbrella of claim 2, wherein the upper clutch tooth mechanism includes a first upper clutch tooth and a second upper clutch tooth which are sleeved and engaged with each other;

the first upper clutch tooth and the second upper clutch tooth are both disposed inside the transverse rod, and the first upper clutch tooth is fixed with the upper end of the transverse rod;

a rotating member is disposed at the top portion of the umbrella frame, and the rotating member is rotatably connected to a top end of the first upper clutch tooth;

a bottom end of the second upper clutch tooth is connected to a top end of the connecting rod;

when the first lower clutch tooth moves downward driven by the adjustment handle to disengage from the second lower clutch tooth, the connecting rod moves downward and drives the second upper clutch tooth to move downward to disengage from the first upper clutch tooth, so as to allow the umbrella frame to rotate left and right.

4. The sunshade umbrella of claim 3, wherein the first lower clutch tooth and the second lower clutch tooth are both circular sleeve structure, and the lower end of the transverse rod is inserted and fixed with a top end of the second lower clutch tooth;

a plurality of ring teeth are disposed at a bottom end of an inner wall of the second lower clutch tooth, and a tooth surface matching the ring teeth is disposed at the top end of the first lower clutch tooth, and a plurality of rotating scales capable of displaying a rotation angle are circumferentially disposed on an outer peripheral surface of the top end of the first lower clutch tooth;

a diameter-expanded stepped hole is disposed at the bottom end of the first lower clutch tooth, a top end of the connector is limited and embedded in the stepped hole, and a bottom end of the connector is rotatably connected to the slidable handle through a fixing member; and the spring is disposed in the stepped hole and is supported between the top end of the connector and a stepped surface of the stepped hole.

5. The sunshade umbrella of claim 4, wherein a connecting pin is disposed on the stepped surface, and the bottom end of the connecting rod passing through an inner hole of the second lower clutch tooth is inserted into the first lower clutch tooth, and is fixedly connected to the connecting pin;

an extension block is disposed on a side portion of the second lower clutch tooth, and a connecting chamber is formed in the extension block;

the lengthened rib is movably disposed in the umbrella frame, and the bottom end of the lengthened rib is inserted into the connecting chamber of the extension block to connect with the second lower clutch tooth.

6. The sunshade umbrella of claim 3, wherein the first upper clutch tooth and the second upper clutch tooth are both circular sleeve structures;

a plurality of ring teeth are disposed at a bottom end of an inner wall of the first upper clutch tooth, and a tooth surface matching the ring teeth is disposed at a top end of the second upper clutch tooth; and the bottom end of the second upper clutch tooth is fixedly connected to the top end of the connecting rod through a screw.

7. The sunshade umbrella of claim 3, wherein a pin hole is radially disposed on the second upper clutch tooth, and a connecting pin is fixed in the pin hole on the second upper clutch tooth;

a guide and limiting groove is disposed on a side portion of the transverse rod, the connecting pin is inserted in the pin hole and matched with the guide and limiting groove, so that the connecting rod is movable, in a limited manner, up and down in the transverse rod;

a guide and fixing seat is disposed at the upper end of the transverse rod, and an upright guide column is disposed at a center of the guide and fixing seat;

a central opening of the second upper clutch tooth is sleeved on the guide column of the guide and fixing seat, and a return spring is disposed between the guide and fixing seat and the second upper clutch tooth, such that the second upper clutch tooth always maintains to be engaged and fixed with the first upper clutch tooth.

8. The sunshade umbrella of claim 3, wherein the rotating member is a hinge, the top end of the first upper clutch tooth is hinged to a side portion of the hinge through a joint, and a bottom end of the hinge is connected to the top portion of the umbrella frame.

9. The sunshade umbrella of claim 8, wherein the umbrella frame comprises a plurality of upper ribs, a plurality of lower ribs, an upper tray, a lower tray and a support post;

the lower tray is slidably disposed at a bottom end of the support post, and the upper tray is disposed in an upper part of the support post;

one end of each of the upper ribs is rotatably connected to the upper tray, and one end of each of the lower ribs is rotatably connected to a middle portion of a respective one of the upper ribs, and the other end of each of the lower ribs is rotatably connected to the lower tray;

a circular hole connected to the hinge is disposed at a top end of the support post, and the hinge is sleeved on the top end of the support post, and the hinge and the support post are connected and fixed by a screw.

10. The sunshade umbrella of claim 1, wherein a top cover is disposed on the top portion of the vertical column;

a drawing rod connecting sleeve is sleeved on the middle portion of the transverse rod, and the rear end of the drawing rod is rotatably connected to the top cover, and the front end of the drawing rod is rotatably connected to the drawing rod connecting sleeve.

* * * * *